US005933917A

United States Patent [19]

Lo

[11] Patent Number: 5,933,917

[45] Date of Patent: Aug. 10, 1999

[54] CASE WITH ADJUSTABLE AND POSITIONABLE HANDLE DEVICE

[75] Inventor: Robert Lo, Taoyuan Hsien, Taiwan

[73] Assignee: Delta Electronics Inc., Taiwan

[21] Appl. No.: 09/003,421

[22] Filed: Jan. 6, 1998

[51] Int. Cl.[6] ..... A47B 95/02

[52] U.S. Cl. ..... 16/112; 16/126

[58] Field of Search ..... 16/112, 125–127, 16/115, 342, 339, 334–336; 190/115, 39

[56] References Cited

U.S. PATENT DOCUMENTS

| | | | |
|---|---|---|---|
| 2,129,095 | 9/1938 | Leland | 16/112 |
| 3,000,049 | 9/1961 | Terry, Jr. | 16/342 |
| 3,082,473 | 3/1963 | West | 16/112 |
| 3,769,655 | 11/1973 | Cartweight | 16/126 |
| 4,617,699 | 10/1986 | Nakamura | 16/262 |
| 4,734,955 | 4/1988 | Connor | 16/332 |
| 5,461,755 | 10/1995 | Hardigg et al. | 16/112 |
| 5,647,095 | 7/1997 | Takimoto | 16/112 |

*Primary Examiner*—Chuck Y. Mah
*Attorney, Agent, or Firm*—Rader, Fishman & Grauer PLLC

[57] ABSTRACT

A handle device adapted to be mounted on a base such as a power supply casing, allowing the orientation thereof to be adjusted arbitrarily within a certain range, and able to be positioned at a desired orientation is disclosed. The handle device includes a securing member for mounting the handle device onto the base, a holding member having a vacancy therein for providing a user to hold the handle device therethrough, and a coupling and positioning member for coupling the holding member to the securing member, and allowing the holding member to be pivotally rotated relative to the securing member, and positioned at several predetermined locations.

10 Claims, 5 Drawing Sheets

CASE WITH ADJUSTABLE AND POSITIONABLE HANDLE DEVICE

FIELD OF THE INVENTION

The present invention is related to a handle device, and more particularly to a handle device which can be adjusted to a desired orientation and positioned at a desired location.

BACKGROUND OF THE INVENTION

In general, a handle device mounted on an object such as a suitcase for allowing a user to hold can be classified as two types, i.e. rotatable one and irrotatable one. An irrotatable handle device 12 is fixed on a surface 111 of the suitcase body 11 in a certain orientation, as shown in FIG. 1, and cannot be adjusted to any other orientation. Such a handle device 12 lengthens the suitcase by a distance X equal to the length of the handle device 12 so as to occupy more space when accommodated.

Referring to FIG. 2, a rotatable handle device 22 includes a fixed portion 221 and a rotatable portion 222. The fixed portion 221 is consisted of two brick pieces 33 separately mounted on a surface 211 of the suitcase body 21. Each of the brick pieces 33 has a concave hole 331 serving as a mortise for receiving one of the two tenons 332 located at both ends of the rotatable portion 222, as shown in FIG. 3. By this way, the handle device 22 can be pivotally rotated on an axis 2 to any orientation within a range of 180 degrees without obstruction. Because of the free rotation, however, it is difficult for the handle device 22 to be positioned at a desired location.

The handle device generally used on a power supply casing is similar to the latter mentioned above. The disadvantage of uncertain location also appears in the handle device of a conventional power supply. Accordingly, the power supply is subject to collision with external objects owing to the unexpected rotation of the handle device.

SUMMARY OF THE INVENTION

An object of the present invention is to provide a handle device allowing the orientation thereof to be adjusted arbitrarily within a certain range, and able to be positioned at a desired location, or orientation.

According to the present invention, an adjustable and positionable handle device adapted to be mounted on a base is provided, and the handle device includes a securing member for mounting the handle device onto the base; a holding member having a vacancy therein for providing a user to hold the handle device therethrough; and a coupling and positioning member having a first part connected to the holding member and a second part connected to the securing member for coupling the holding member to the securing member through the engagement of the first and the second parts, a relative rotation between the first part and the second part allowing the holding member to pivotally rotate relative to the securing member, and allowing the holding member to be positioned at a desired location.

In an embodiment of the present invention, the securing member includes two securing pieces separately fixed on the base, the holding member includes a holding piece of an inverse U shape, and the two feet of the holding piece are connected to the two securing pieces, respectively, through the coupling and positioning member.

Preferably, the first part includes two cylindrical posts respectively protruding inwards from the two feet of the holding piece, the second part includes two concave holes respectively located in the two securing pieces, and the two cylindrical posts are respectively inserted into the two concave holes to coupling the holding member to the securing member.

More preferably, the first part further includes a plurality of grooves so that each of the two cylindrical posts is arranged thereon at least one grooves along an axial direction, the second part further includes two elastic pieces, each of which has a bump and protrudes into one of the two concave holes, and the bump can be blocked by a specific one of the at least one grooves to have the holding member positioned at a desired location, and released from the specific one groove by rotating the cylindrical post relative to the concave hole.

The first and the second parts of the coupling and positioning member can be integrally formed with the holding member and securing member, respectively, but do not have to.

The base for mounting thereon the handle device can be a surface of a casing.

BRIEF DESCRIPTION OF THE DRAWING

The present invention may best be understood through the following description with reference to the accompanying drawings, in which:

FIGS. 5A~5B schematically show two locations that a handle device according to the present invention can be positioned at.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
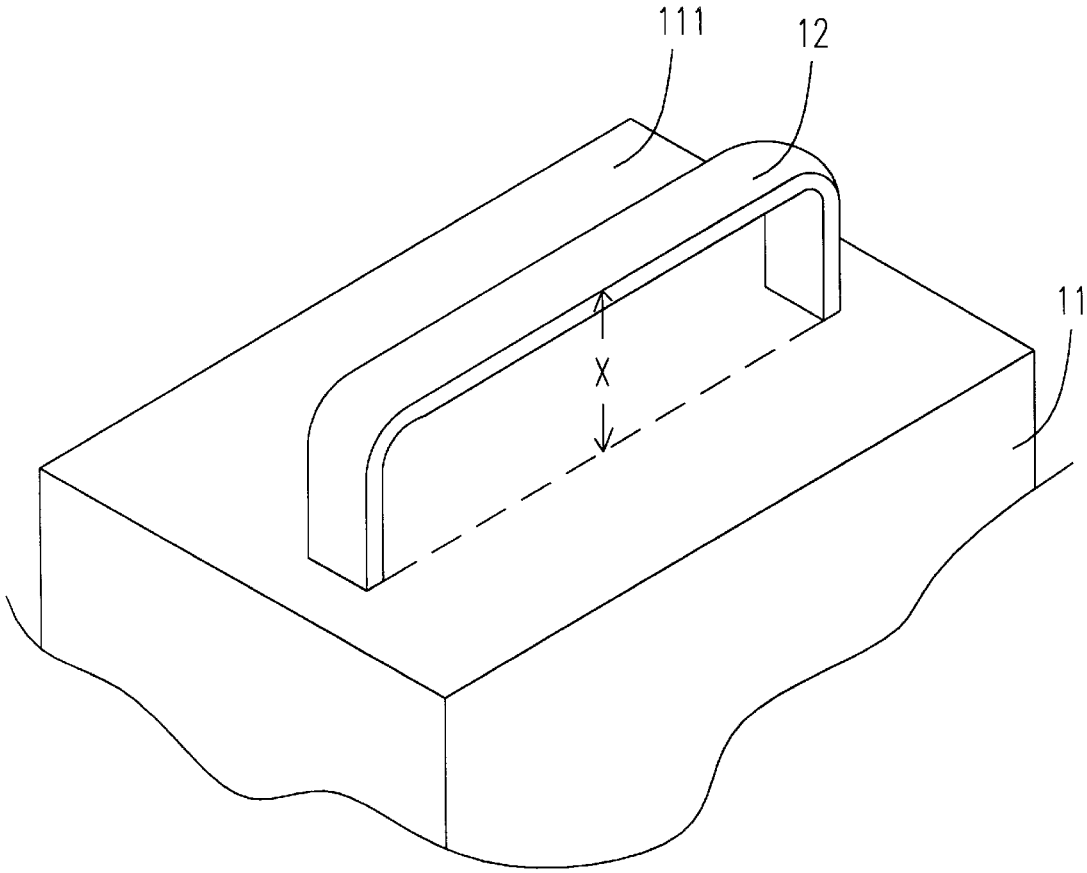
Fig. 1(PRIOR ART)
FIG. 1 is a schematic diagram showing a conventional handle device.
Figure 2:
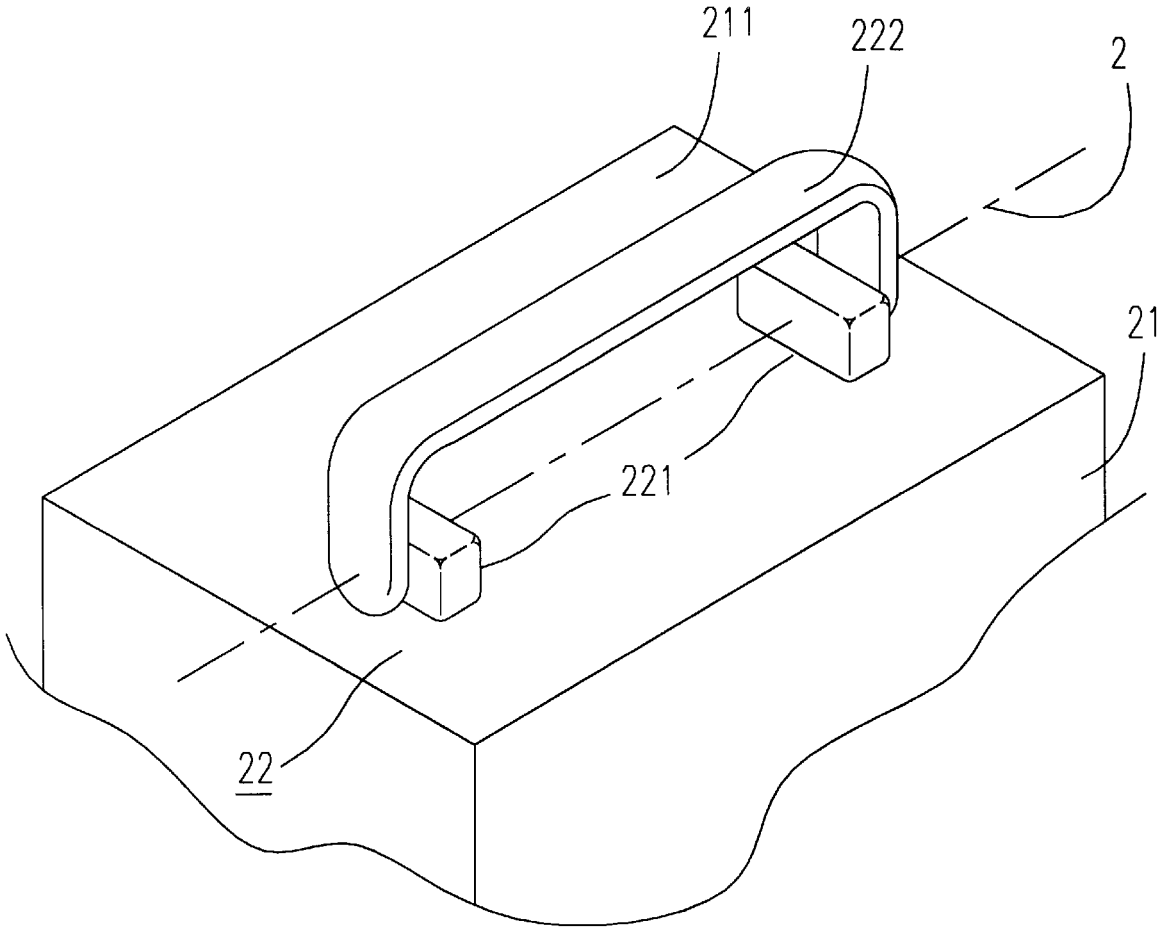
Fig. 2(PRIOR ART)
FIG. 2 is a schematic diagram showing another conventional handle device.
Figure 3:
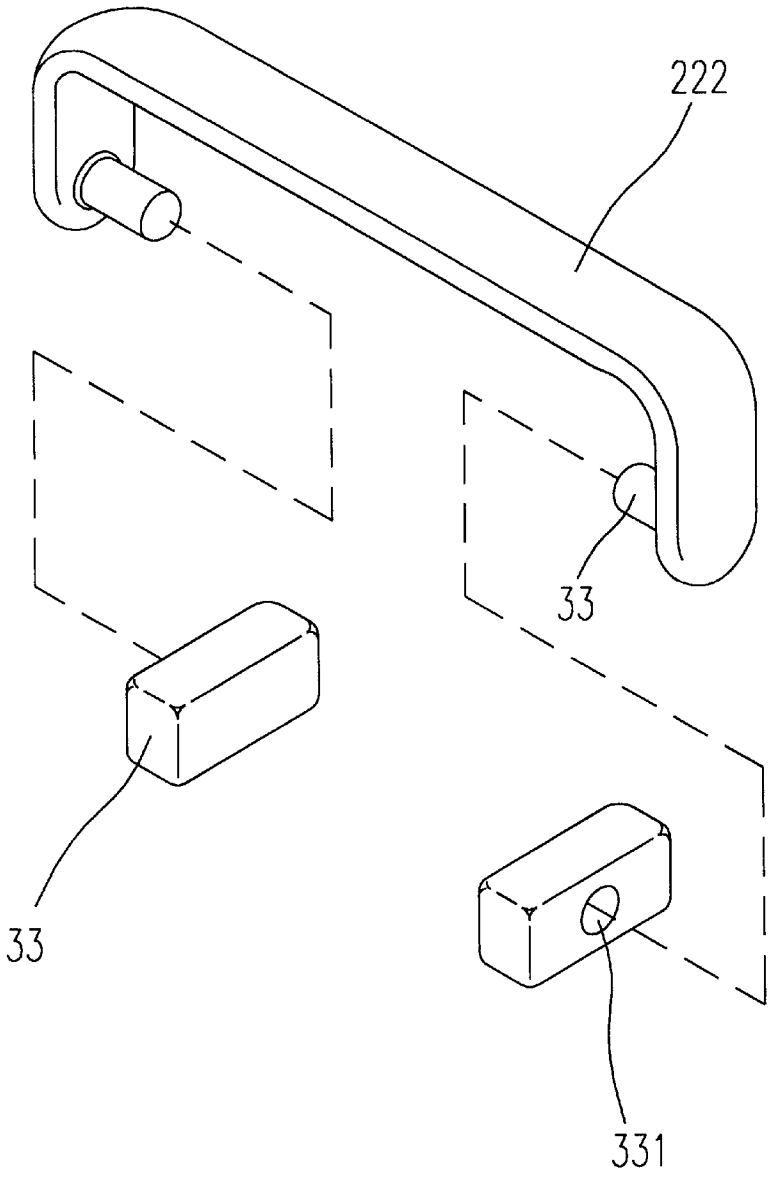
Fig. 3(PRIOR ART)
FIG. 3 schematically shows the assembling of the handle device of FIG. 2.
Figure 4:
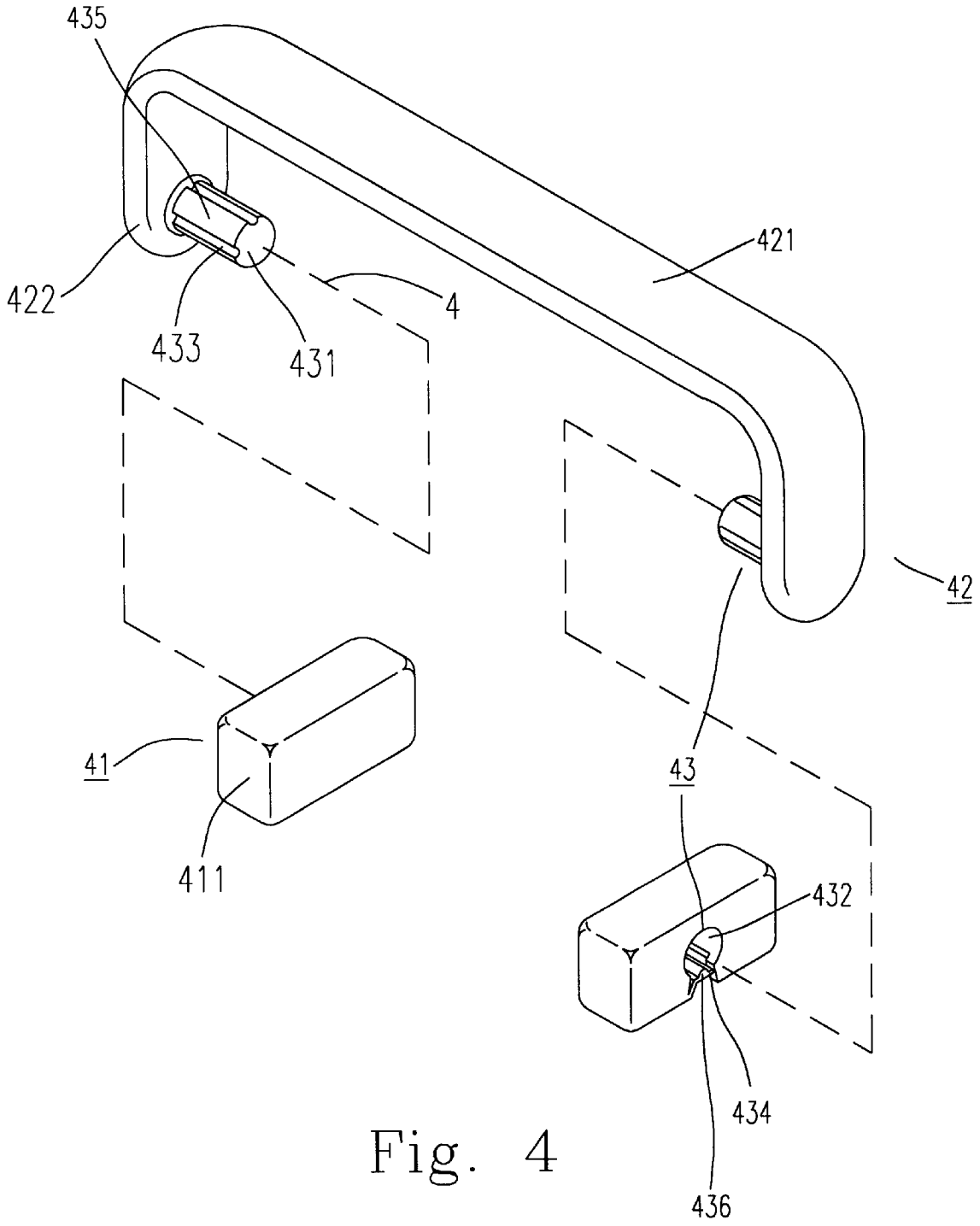
FIG. 4 schematically shows the assembling of a preferred embodiment of a handle device according to the present invention.

Please refer to FIG. 4 which schematically shows the assembling of a preferred embodiment of a handle device according to the present invention. The handle device shown in FIG. 4 includes a securing member 41, a holding member 42, and a coupling and positioning member 43. The securing member 41 is consisted of two brick pieces 411 to be separately mounted on a base (FIG. 5). The holding member 42 is consisted of an inverse U-shaped piece 421. The coupling and positioning member 43 includes two cylindrical posts 431 securely connected to two feet 422 of the holding member 42, and two concave holes 432 arranged in the two brick pieces 411, respectively. Each of the posts 431 is arranged thereon at least one grooves 433 along an axial direction 4, depending on the number of desired locations that the handle device is to be positioned. In each of the concave holes 432, an elastic piece 434 having a bump 436 is provided. In this preferred embodiment, the cylindrical posts 431 can be integrally formed with the holding piece 422, and the elastic piece 434 with the bump 436 can be integrally formed with the brick piece 411.

When the posts 431 are inserted into the holes 432, the holding member 42 is coupled to the securing member 41, and the holding member 42 can be pivotally rotated relative to the securing member 41 through the rotation of the posts 431 in the respective holes 432. During the relative rotation of the posts 431 in the holes 432, the elastic piece 434 will be slightly moved outwards when the bump 436 is in contact with a smooth area 435 of the post 431, and the bump 436 will be blocked in the groove 433 when the bump 436 enters any of grooves 433. The blocking of the bump 436 in the specific groove 433 makes the holding member 42 unmoved relative to the securing member 41 so that the holding member 42 is positioned at that location. When the holding member 42 is to be moved to another location and positioned, a user can hold and rotate the holding piece 421 to rotate the posts 431 to make the bumps 436 blocked in other grooves 433.

The handle device according to the present invention can be applied to a power supply casing for facilitating to move or carry the power supply. When used with the power supply casing, it is preferred that the handle device can be positioned at an easy-holding location when the power supply is to be moved or carried, and positioned at a safe location when the power supply is settled down.

Figure 5A:
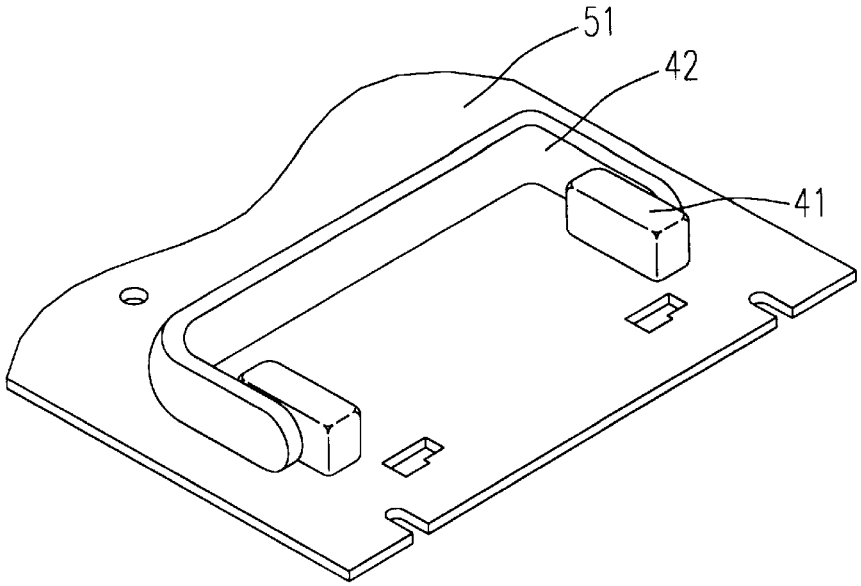
Figure 5B:
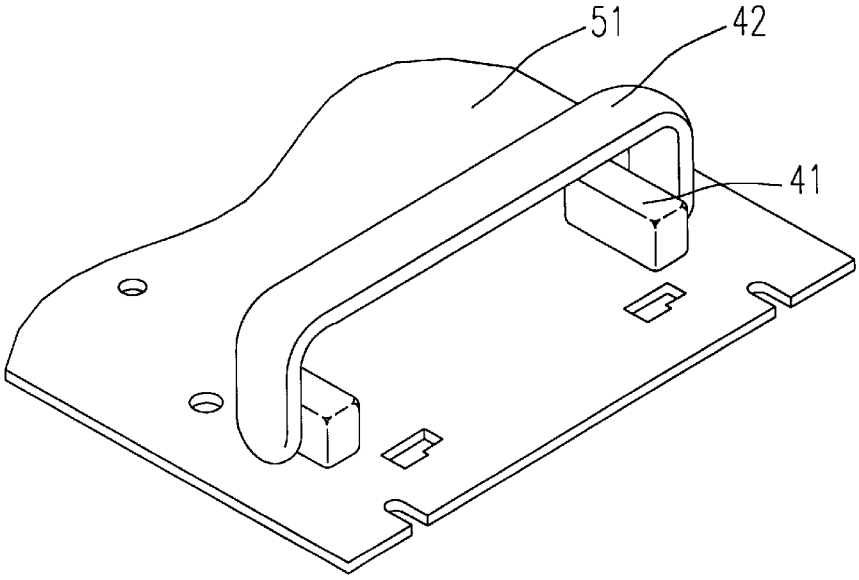

Please refer to FIGS. 5A~5B which schematically show two locations that a handle device according to the present invention can be positioned at. In this preferred embodiment, two grooves are arranged on each of the posts, and one of the grooves is a quarter of circumference apart from the other. When a power supply 51 has been installed well in a machine (not shown), the holding member 42 is preferably positioned at the location close to the power supply casing, as shown in FIG. 5A, so as to reduce the occupied space of the power supply 51, and avoid careless collision. On the contrary, when the power supply 51 needs to be moved, the holding member 42 is preferably rotated 90 degrees to be positioned in an orientation substantially perpendicular to the surface the handle device is mounted on, as shown in FIG. 5B, so that a user's hand can penetrate the vacancy 52 to hold the holding member 42 to carry the power supply 51.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A case comprising:

a base; and an adjustable and positionable handle device mounted on said base, the adjustable and positionable handle device including a securing member for mounting said handle device onto said base, a holding member formed to define a vacancy therein for facilitating holding said handle device, and a coupling and positioning member having two first parts connected to said holding member, two second parts connected to said securing member, and two elastic pieces respectively disposed between said two first parts and said two second parts for coupling said holding member to said securing member through the engagement of said first parts and said second parts, a relative motion between said first part and said second part allowing said holding member to pivotally rotate relative to said securing member, and allowing said holding member to be positioned at a desired location.

2. The case of claim 1, wherein said securing member includes two securing pieces separately fixed on said base, said holding member includes a holding piece of an inverse U shape having two feet connected to said two securing pieces, respectively, through said two first parts of said coupling and positioning member.

3. The case of claim 2, wherein said two first parts are two cylindrical posts respectively protruding inwards from said two feet of said holding piece, said two second parts define two concave holes respectively located in said two securing pieces, and said two cylindrical posts are respectively inserted into said two concave holes for coupling said holding member to said securing member.

4. The case of claim 3, wherein each of said two first parts is provided with a plurality of grooves so that each of said two cylindrical posts is arranged thereon said grooves along an axial direction thereof, each said plastic piece has a bump and protrudes into one of said two concave holes, and said bump can be blocked by a specific one of the plurality of grooves to have said holding member positioned at a desired location, and released from said specific one groove by rotating said cylindrical post relative to said concave hole.

5. The case of claim 1, wherein each of said first parts of said coupling and positioning member is integrally formed with said holding member.

6. The case of claim 1, wherein each of said second parts of said coupling and positioning member is integrally formed with said securing member.

7. The case of claim 1, wherein said base for mounting thereon said handle device is a surface of said case.

8. An adjustable and positionable handle device comprising:

a securing member for mounting said handle device onto a base;

a holding member defining a vacancy therein for facilitating holding the handle device; and a coupling and positioning member having two first parts connected to said holding member, two second parts connected to said securing member, and two elastic pieces respectively disposed between said two first parts and said two second parts for coupling said holding member to said securing member through the engagement of said first parts and said second parts, a relative rotation between said first parts and said second parts allowing said holding member to pivotally rotate relative to said securing member, and allowing said holding member to be positioned at a desired location.

9. The handle device of claim 8, wherein said securing member includes two securing pieces separately fixed on said base, said holding member includes a holding piece of an inverse U shape, said two first parts are two cylindrical posts respectively protruding inwards from said two feet of said holding piece, said two second parts define two concave holes respectively located in said two securing pieces, and said two cylindrical posts are respectively inserted into said two concave holes for coupling said holding member to said securing member.

10. The handle device of claim 9, wherein each of said first parts has a plurality of grooves so that each of said two cylindrical posts is arranged thereon along an axial direction thereof, each said elastic piece has a bump and protrudes into one of said two concave holes, and said bump can be blocked by a specific one of said at least one groove to have said holding member positioned at a desired location, and released from said specific one groove by rotating said cylindrical post relative to said concave hole.

* * * * *